US008283047B2

(12) United States Patent
Vogt et al.

(10) Patent No.: US 8,283,047 B2
(45) Date of Patent: Oct. 9, 2012

(54) METHOD OF MAKING COMPOSITE CASTING AND COMPOSITE CASTING

(75) Inventors: Russell G. Vogt, Yorktown, VA (US); George W. Wolter, Whitehall, MI (US)

(73) Assignee: Howmet Corporation, Whitehall, MI (US)

( * ) Notice: Subject to any disclaimer, the term of this patent is extended or adjusted under 35 U.S.C. 154(b) by 0 days.

(21) Appl. No.: 11/449,389

(22) Filed: Jun. 8, 2006

(65) Prior Publication Data

US 2007/0284073 A1 Dec. 13, 2007

(51) Int. Cl.
*B22D 7/00* (2006.01)
*B32B 5/02* (2006.01)
*B32B 15/04* (2006.01)

(52) U.S. Cl. ..... 428/614; 428/615; 428/627; 428/457; 428/469; 164/75; 164/98

(58) Field of Classification Search ..... None
See application file for complete search history.

(56) References Cited

U.S. PATENT DOCUMENTS

| | | | | |
|---|---|---|---|---|
| 3,717,443 | A | 2/1973 | McMurray et al. | 29/191.4 |
| 3,972,367 | A | 8/1976 | Gigliotti, Jr. et al. | 164/72 |
| 4,008,052 | A | 2/1977 | Vishnevsky et al. | 29/194 |
| 4,040,845 | A | 8/1977 | Richerson et al. | 106/38.9 |
| 4,376,803 | A * | 3/1983 | Katzman | 428/408 |
| 4,485,150 | A | 11/1984 | Tsuno | 428/633 |
| 4,559,277 | A | 12/1985 | Ito | 428/627 |
| 4,572,270 | A | 2/1986 | Funatani et al. | 164/97 |
| 4,703,806 | A | 11/1987 | Lassow et al. | 164/518 |
| 4,787,439 | A | 11/1988 | Feagin | 164/518 |
| 4,853,294 | A * | 8/1989 | Everett et al. | 428/614 |
| 4,889,177 | A | 12/1989 | Charbonnier et al. | 164/97 |
| 4,921,822 | A | 5/1990 | Luthra | 501/95 |
| 4,962,070 | A * | 10/1990 | Sullivan | 501/95.1 |
| 5,241,737 | A | 9/1993 | Colvin | 29/526.2 |
| 5,241,738 | A | 9/1993 | Colvin | 29/526.2 |
| 5,244,748 | A * | 9/1993 | Weeks et al. | 428/614 |
| 5,263,530 | A | 11/1993 | Colvin | 164/100 |
| 5,506,061 | A * | 4/1996 | Kindl et al. | 428/549 |
| 5,678,298 | A | 10/1997 | Colvin et al. | 29/526.2 |
| 5,712,435 | A | 1/1998 | Feagin | 75/230 |
| 5,716,720 | A | 2/1998 | Murphy | 428/623 |
| 5,752,156 | A * | 5/1998 | Chen et al. | 419/11 |
| 5,823,243 | A | 10/1998 | Kelly | 164/57.1 |
| 5,944,088 | A | 8/1999 | Feagin | 164/369 |
| 5,981,083 | A | 11/1999 | Colvin et al. | 428/608 |
| 6,189,413 | B1 | 2/2001 | Morse et al. | 74/607 |
| 6,582,763 | B1 * | 6/2003 | Nishimura et al. | 427/216 |

(Continued)

FOREIGN PATENT DOCUMENTS

| | | | |
|---|---|---|---|
| EP | 0 365 978 | | 5/1990 |
| EP | 0384045 | | 8/1990 |
| GB | 2 219 006 | A | 11/1989 |
| GB | 2 279 667 | * | 1/1995 |
| WO | 95/26431 | * | 10/1995 |

OTHER PUBLICATIONS

JP 02-190428 English Abstract from Derwent, Jul. 1990.*

(Continued)

*Primary Examiner* — Jennifer McNeil
*Assistant Examiner* — Jason L Savage

(57) ABSTRACT

Method of making a composite casting involves providing a reinforcement insert with a ceramic coating, positioning the coated insert in a mold, and casting the molten metallic material into the mold where the metallic material is solidified. The composite casting produced includes the reinforcement insert disposed in a solidified metallic matrix with a ceramic coating between the reinforcement insert and the matrix.

14 Claims, 2 Drawing Sheets

U.S. PATENT DOCUMENTS

| | | | | |
|---|---|---|---|---|
| 6,648,060 | B1 | 11/2003 | Yang | 164/519 |
| 6,688,254 | B2 | 2/2004 | Callaway et al. | 118/723 |
| 7,820,299 | B2 * | 10/2010 | Andreussi et al. | 428/469 |
| 2002/0107133 | A1 | 8/2002 | Troczynski et al. | 501/1 |
| 2002/0136857 | A1 * | 9/2002 | Francois | 428/67 |
| 2004/0020627 | A1 * | 2/2004 | Blucher et al. | 164/97 |

OTHER PUBLICATIONS

K.L. Choy et al., "Effect of TiB2, TiC and TiN protective coatings on tensile etc . . . ", pp. 531-539, vol. 26 No. 8, 1995.

Kwang-Leong Choy et al., "Potential coating systems for inhibiting SiC/Ti etc . . . ", 1995, pp. 179-184.

M.P. Thomas et al., "Comparison of low cycle fatigue performance of several etc . . . ", 2001, pp. 851-856.

K.-L. Choy, et al., The CVD of $TiB_2$ Protective Coating on SiC Monofilament Fibres, Journal De Physique IV, Colloque C2, suppl. Au Journal de PhysiqueII, vol. 1, Sep. 1991.

K.-L. Choy, et al., The CVD of Ceramic Protective Coatings on SiC Monofilaments for Use in Titanium Based Composites, Materials and Manufacturing Processes, vol. 9, No. 5, 1994, pp. 885-900.

* cited by examiner

METHOD OF MAKING COMPOSITE CASTING AND COMPOSITE CASTING

FIELD OF THE INVENTION

The present invention relates to a method of making a composite casting having a preformed reinforcement insert therein as well as the composite casting.

BACKGROUND OF THE INVENTION

Components of aerospace, automotive, and other service applications have been subjected to the ever increasing demand for improvement in one or more mechanical properties while at the same time maintaining or reducing weight of the component. To this end, U.S. Pat. Nos. 4,889,177 and 4,572,270 describe a magnesium or aluminum alloy castings having a fibrous insert of high strength ceramic fibers therein.

U.S. Pat. No. 5,981,083 describes a method of making a composite casting wherein a reinforcement insert, such as a fiber reinforced metal matrix insert or intermetallic reinforcing insert, is captured in a cast component and includes cladding on the reinforcement insert to react with the molten metallic material to provide a ductile, void-free metallurgical bond between the reinforcement insert and the cast matrix. For reactive molten titanium base alloy, the cladding comprises a titanium beta phase stabilizer, such as Nb or Ta cladding, that reacts with the molten titanium base alloy to form a relatively ductile beta phase stabilized region between the reinforcement insert the solidified titanium base alloy matrix.

SUMMARY OF THE INVENTION

The present invention provides in an embodiment thereof a method of making a composite casting including the steps of providing a reinforcement insert with a ceramic coating, positioning the coated reinforcement insert in a mold, and introducing the molten metallic material into the mold where the metallic material is solidified. The ceramic coating remains in the casting between the reinforcement insert and the solidified metallic matrix.

In an illustrative embodiment of the present invention, the molten metallic material comprises a reactive molten metal or alloy, such as molten titanium or molten titanium alloy. The reinforcement insert comprises silicon carbide, boron carbide, silicon nitride, or an intermetallic compound, such as TiAl, having a ceramic coating comprising erbium oxide or yttrium oxide. The ceramic coating can be applied to the reinforcement insert by vapor deposition, by plasma or flame spraying, or by applying ceramic slurry to the insert and drying the slurry.

In another embodiment of the present invention, a composite casting is provided having a reinforcement insert disposed in a metallic matrix with a ceramic material between the reinforcement insert and the matrix.

In an illustrative embodiment of the present invention, the metallic matrix comprises titanium or a titanium alloy and the reinforcement insert comprises silicon carbide, boron carbide, silicon nitride, or an intermetallic compound disposed in the matrix with an erbium oxide or yttrium oxide material between the reinforcement insert and the matrix.

Other advantages, features, and embodiments of the present invention will become apparent from the following description.

DESCRIPTION OF THE INVENTION

Figure 1B:
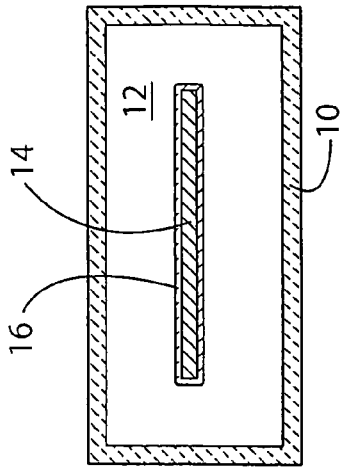
FIGS. 1A and 1B are schematic view illustrating a ceramic investment shell mold having a plurality of mold cavities with a ceramic coated reinforcement insert positioned in each mold cavity pursuant to an illustrative embodiment of the invention.
Figure 1A:
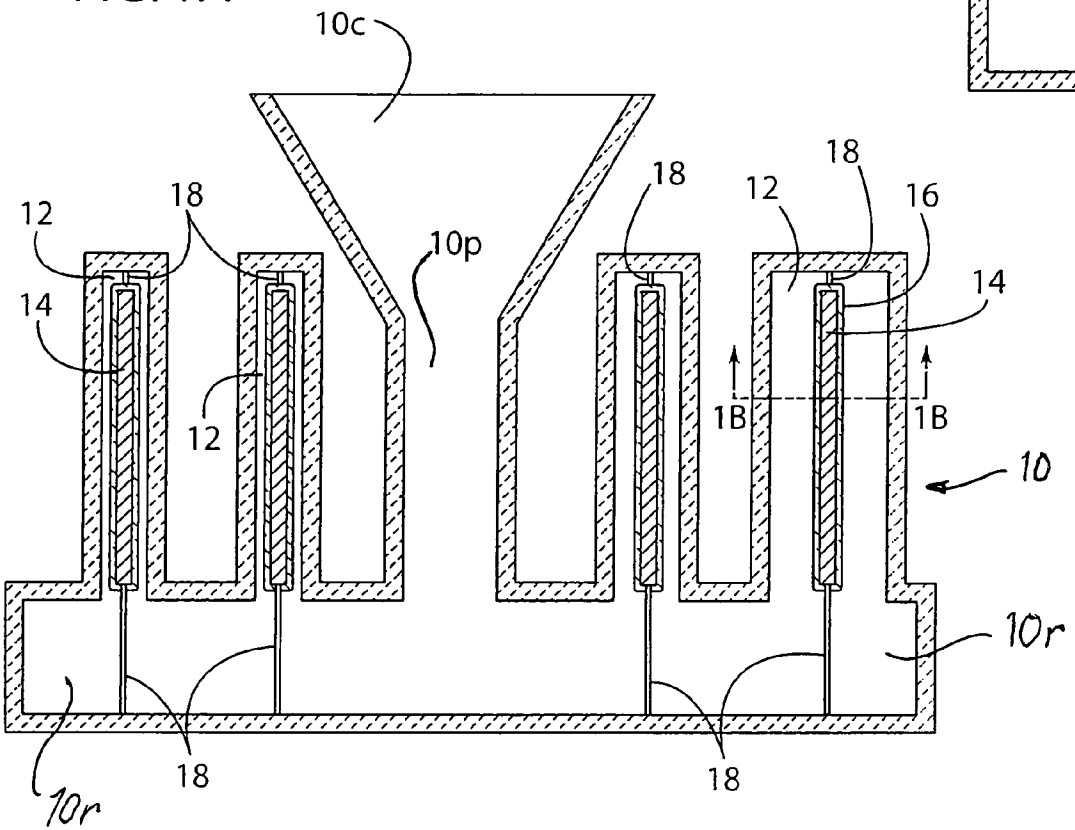

The present invention provides a method of making a composite casting wherein a reinforcement insert is disposed in a metallic matrix to provide reinforcement of the matrix. For purposes of illustration and not limitation, FIGS. 1A and 1B illustrates a ceramic investment shell mold 10 having a plurality of mold cavities 12 with reinforcement insert 14 positioned in each mold cavity. The shape of the mold cavities 12 will correspond to the shape of each composite casting to be produced. The reinforcement insert 14 can be made from any ceramic material or intermetallic material having the desired properties for reinforcement and can have any shape or configuration to achieve a desired reinforcing effect in the composite casting. The reinforcement inserts 14 themselves can be reinforced with fibers, particles or the like. Although plate-shaped inserts 14 are illustrated residing in rectangular mold cavities 12 in FIGS. 1A and 1B, this is merely for convenience for purposes of illustrating the invention and not limiting it. The invention can be practiced with various types of molds including, but not limited to, ceramic shell molds, metallic (e.g. steel) molds, graphite molds and other refractory molds.

Before each reinforcement insert 14 is positioned in a respective mold cavity 12, it is coated with a protective ceramic coating 16 that preferably is substantially non-reactive with the molten metallic material to be cast about the insert 14 in the mold cavity 12 to form the solidified metallic matrix. The ceramic coating material preferably is chosen to be substantially non-reactive with the particular molten metallic material to be cast into the mold cavities 12 in that at least some of the thickness of the ceramic coating remains after the molten metallic material has been cast and solidified about the reinforcement insert. The ceramic coating 16 thus is chosen according to the molten metallic material to be cast in the mold 10. The ceramic coating can applied to the insert by vapor deposition (e.g. chemical vapor deposition, electron beam physical vapor deposition, physical vapor deposition, etc.), by plasma or flame (e.g. HVOF) spraying, or by applying a ceramic slurry to the insert and drying the slurry. The ceramic coating can be applied to any appropriate thickness on the reinforcement insert. For purposes of illustration and not limitation, the thickness of the ceramic coating can be from about 0.1 or less mil and up to about 5 mils.

Coating of the reinforcement insert 14 with the ceramic coating 16 pursuant to the invention is especially useful, although not limited to, making composite castings that are made by casting a reactive molten metal or alloy in the mold 10.

For purposes of illustration, titanium and its alloys form reactive molten melts that can react with the reinforcement insert 14 if it is not coated to generate casting porosity and to degrade the reinforcement insert. Illustrative titanium alloys include, but are not limited to, Ti-6Al-4V, Ti-5Al-5Mo-5V-3Cr, and Ti-6Al-2Sn-4Zr-2Mo where the numeral represents weight percent of the particular element (e.g. Ti-6Al-4V includes 6 weight % Al and 4 weight % V, balance Ti). In casting titanium alloys, a slight oxygen enriched layer may be formed on the outer surface of the alloy casting but the ceramic coating on the reinforcement insert 14 is substantially non-reactive with the alloy.

When the molten metallic material comprises reactive molten titanium or molten titanium alloy, the reinforcement insert 14 can comprise silicon carbide (e.g. SiC), boron carbide (e.g. $B_4C$), silicon nitride (e.g. $Si_3N_4$), or an intermetallic compound, such as TiAl, coated with a ceramic coating 16 preferably comprising erbium oxide or yttrium oxide. The reinforcement insert 14 itself may comprise a titanium matrix composite (TCM) having SiC and/or SiN fibers residing in a titanium matrix as described in U.S. Pat. No. 5,981,083, which is incorporated herein by reference. The erbium oxide or yttrium oxide coating 16 can be applied to the reinforcement insert 14 preferably by chemical vapor deposition, electron beam physical vapor deposition, physical vapor deposition and other vapor deposition processes, although other coating methods can be employed.

After the reinforcement insert 14 is coated with the ceramic coating 16, each insert 14 is positioned in a respective mold cavity 12 of mold 10. Mold 10 is illustrated in FIG. 1 as comprising a ceramic investment shell mold made by the well known lost wax process. However, the invention envisions using any type of metal, ceramic and/or refractory mold to receive the reinforcement insert 14 and the molten metallic material in a mold cavity thereof.

The coated reinforcement insert 14 can be positioned in each mold cavity 12 of mold 10 by any suitable insert positioning means. For purposes of illustration and not limitation, FIG. 1 illustrates each reinforcement insert 14 as being positioned in a respective mold cavity 12 by pins or chaplets 18 engaging opposite ends of each reinforcement insert as described in U.S. Pat. Nos. 5,981,083; 5,241,738; and 5,241,737, all incorporated herein by reference. Depending upon the configuration of the reinforcement insert, clamp devices residing outside the mold may be used to hold the reinforcement insert in position in the mold.

The molten metallic material then is introduced (e.g. gravity poured) into the mold 10 via a pour cup 10*c*, which conveys the molten metallic material via a down sprue 10*p* and runners 10*r* to the mold cavities 12 where the molten metallic material fills each mold cavity, surrounds the reinforcement insert 14 therein, and solidifies to form a composite casting in each mold cavity. The composite casting comprises reinforcement insert 14 disposed in a metallic matrix formed by the solidified metallic material with the ceramic coating material between the reinforcement insert and the metallic matrix. In the illustrative embodiment of the present invention discussed above, the metallic matrix comprises titanium or a titanium alloy and the reinforcement insert comprises silicon carbide, silicon nitride, or an intermetallic compound disposed in the matrix.

The composite castings produced in the mold 10 are freed by a knock-out operation where the mold is struck with a hammer to knock off the ceramic mold material followed by sand blasting to remove remaining ceramic mold material on the composite castings.

After the composite castings are removed from the mold 10, they optionally can be subjected to a hot isostatic pressing (HIP) operation as described in U.S. Pat. No. 5,981,083, already incorporated herein by reference.

The following EXAMPLES are offered to further illustrate but not limit the invention.

EXAMPLES

Figure 2:
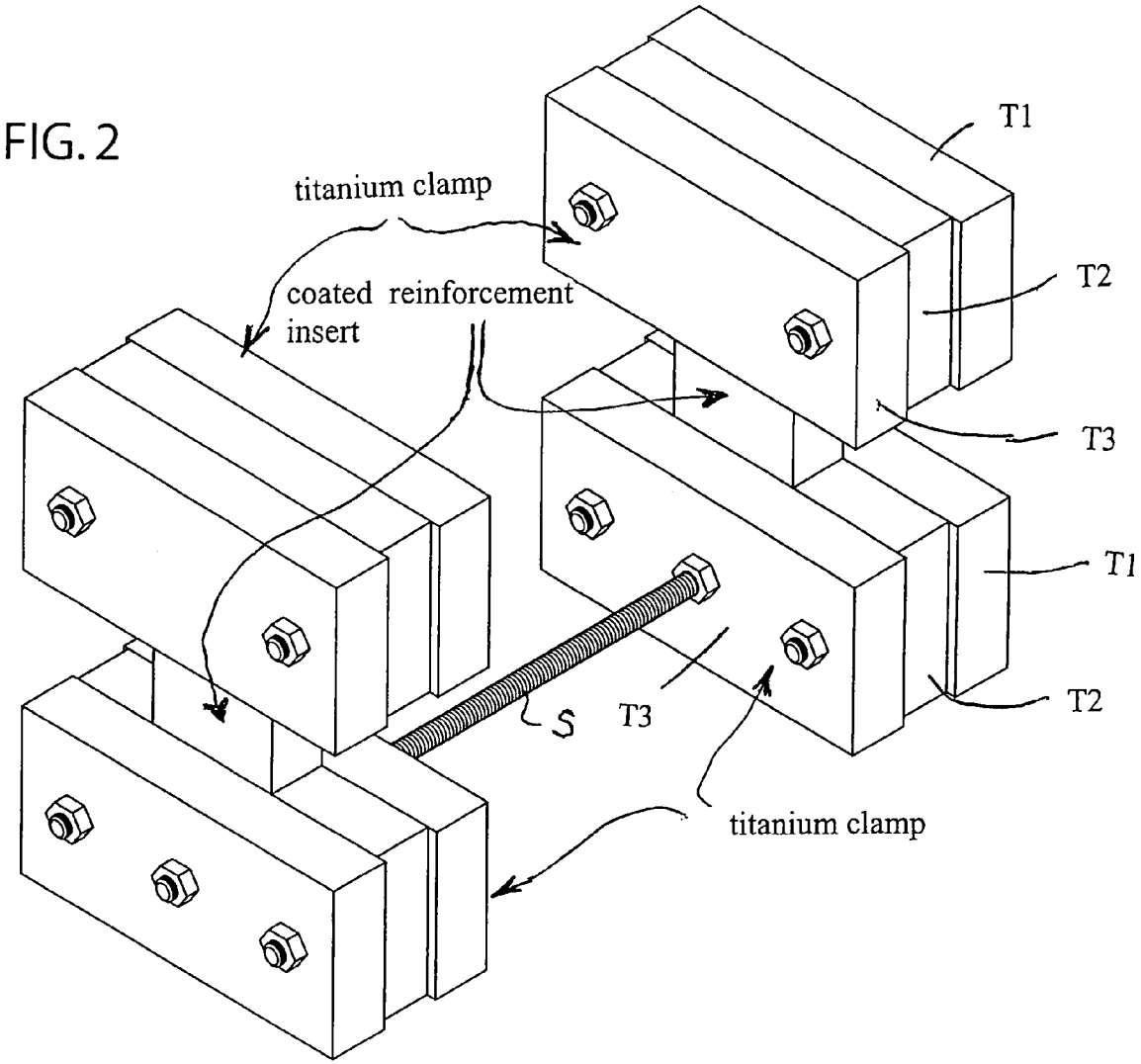
FIG. 2 is a perspective view of a ceramic coated silicon carbide reinforcement insert clamped at its ends between titanium plates prior to placement in a casting mold pursuant to an illustrative embodiment of the invention.

Referring to FIG. 2, a pair of ceramic (yttria or erbia) coated silicon carbide (SiC) reinforcement inserts are shown each clamped at their respective ends between titanium clamps shown. The titanium clamps comprised titanium clamping plates T1, T2, T3 and titanium nuts and bolts as shown to hold the clamping plates together. The titanium clamps were held in position relative to one another in a mold by a threaded screw S extending therebetween as shown.

In particular, a pair of SiC reinforcement inserts of the type shown in FIG. 2 were made by first depositing a yttria (yttrium oxide) coating on each reinforcement insert as a substrate to a thickness of about 0.5-1 mil by electron beam-physical vapor deposition and clamping the coated reinforcement inserts as shown in FIG. 2. Another pair of reinforcement inserts of the type shown in FIG. 2 were made by first depositing an erbia (erbium oxide) coating on each silicon carbide reinforcement insert to a thickness of about 0.5-1 mil by electron beam-physical vapor deposition and then clamping the coated reinforcement inserts as shown in FIG. 2.

Deposition of the yttria or erbia ceramic coating was conducted using electron beam physical vapor deposition equipment and processing described in U.S. Pat. No. 5,716,720 with the temperature control lid feature of U.S. Pat. No. 6,688,254 to control SiC reinforcement insert (substrate) temperature during the coating deposition process, both of these patents being incorporated herein by reference. The temperature of the SiC reinforcement insert was maintained in the range of 1825 to 1920 degrees F. during deposition using the temperature control lid feature of U.S. Pat. No. 6,688,254.

In depositing the yttria or erbia ceramic coating pursuant to this example, the source material of yttria (yttrium oxide) or erbia (erbium oxide) was a cylinder with nominal dimensions of 2.5 inches diameter and 7.5 inches in length wherein the electron beam impinged the end of the cylinder. The processing sequence employed a vacuum of $1\times10^{-4}$ torr in the loading chamber where the SiC reinforcement insert was mounted on the part manipulator. The reinforcement insert mounted with a flat major side adjacent the part manipulator then was moved into the preheat chamber through an open valve connecting the loading chamber and the preheat chamber. The reinforcement insert was heated to 1900 to 1950 degrees F. in the preheat chamber by radiant heating from resistively heated graphite heating elements. The preheated reinforcement insert then was moved into the coating chamber above the end of the cylinder of yttria or erbia source material. In the coating chamber, the electron beam (power level of 80-90 kW) from an electron gun was scanned over the end of a cylinder of yttria or erbia source material to evaporate it. For yttria or erbia source material, oxygen was introduced into the coating chamber to produce a pressure of 1-20 microns. The SiC reinforcement insert was rotated by the part manipulator above the source material in the cloud of evaporated yttria or erbia material in the coating chamber. Rotation of the reinforcement insert was conducted in the range of 1-15 rpm. Once the proper coating time and thus coating thickness was produced on the major side of the reinforcement insert, the manipulator was retracted to locate the insert back into the loading chamber where it cooled. The valve between the loading chamber and the preheating chamber was closed. Once cool, the loading chamber was opened and the SiC reinforcement insert was removed. The insert then was reloaded on the part manipulator for coating of the opposite major side thereof, which was mounted against the part manipulator during the first coating cycle and thus was not coated. The narrow edges of the SiC reinforcement insert received two coating layers of yttria or erbia as a result of the two coating cycles needed to coat both major sides of the insert.

Deposition was conducted for a time to produce the desired thickness of yttria or erbia on each side of the reinforcement insert. In particular, a continuous yttria or erbia coating approximately 0.001 to 0.002 inch in thickness was deposited on the side of the SiC reinforcement insert depending upon the source material employed.

The two pairs of coated reinforcement inserts clamped in the titanium clamps described above and shown in FIG. 2 were placed in a cylindrical steel mold having a diameter of 4 inches and length of 5 inches with the titanium clamps resting on the bottom wall of the mold. A titanium melt was cast under vacuum at a temperature greater than 2900 degrees F. into the mold and solidified to form a composite casting comprising a titanium matrix having the clamped coated silicon carbide reinforcement inserts embedded therein. Metallographic examination of the composite casting revealed that there was no reaction between the titanium melt and the yttria coating or erbia coating on the silicon carbide reinforcement insert such that the reinforcement inserts were protected from reaction with the titanium melt.

Although the invention has been shown and described with respect to detailed embodiments thereof, it will be understood by those skilled in the art that various changes in form and detail thereof may be made without departing from the spirit and scope of the claimed invention.

We claim:

1. A composite casting, comprising a reinforcement insert having an oxide ceramic insert coating thereon and disposed in a cast and solidified metallic matrix with the cast and solidified matrix against the ceramic insert coating wherein the ceramic insert coating has a thickness of about 0.1 mil to about 5 mils and is substantially non-reacted with the cast and solidified matrix.

2. The casting of claim 1 wherein the metallic matrix comprises titanium or a titanium alloy.

3. The casting of claim 1 wherein the insert comprises silicon carbide.

4. The casting of claim 1 wherein the insert comprises boron carbide.

5. The casting of claim 1 wherein the insert comprises silicon nitride.

6. The casting of claim 1 wherein the insert comprises an intermetallic compound.

7. The casting of claim 1 wherein the oxide ceramic material comprises erbium oxide or yttrium oxide.

8. The casting of claim 1 wherein the insert is plate-shaped.

9. A composite casting, comprising a reinforcement insert having a ceramic insert coating and disposed in a cast and solidified metallic matrix comprising titanium with the cast and solidified matrix against the ceramic insert coating wherein the ceramic insert coating is selected from the group consisting of erbium oxide and yttrium oxide and the matrix and wherein the ceramic insert coating has a thickness of about 0.1 mil to about 5 mils and is substantially non-reacted with the cast and solidified matrix comprising titanium.

10. The casting of claim 9 wherein the insert comprises silicon carbide.

11. The casting of claim 9 wherein the insert comprises boron carbide.

12. The casting of claim 9 wherein the insert comprises silicon nitride.

13. The casting of claim 9 wherein the insert comprises an intermetallic compound.

14. The casting of claim 9 wherein the insert is plate-shaped.

* * * * *

UNITED STATES PATENT AND TRADEMARK OFFICE

CERTIFICATE OF CORRECTION

PATENT NO. : 8,283,047 B2
APPLICATION NO. : 11/449389
DATED : October 9, 2012
INVENTOR(S) : Russell G. Vogt et al.

It is certified that error appears in the above-identified patent and that said Letters Patent is hereby corrected as shown below:

Column 6, Claim 9, line 20, delete “and the matrix”.

Signed and Sealed this
Twenty-ninth Day of January, 2013

David J. Kappos

David J. Kappos
*Director of the United States Patent and Trademark Office*